United States Patent [19]

Schultes et al.

[11] 4,157,059

[45] Jun. 5, 1979

[54] COPY SET SEPARATING TRAY FOR DOCUMENT COPIER

[75] Inventors: Max Schultes, Old Tappan, N.J.; Dietmar Eberlein, New City, N.Y.

[73] Assignee: Savin Corporation, Valhalla, N.Y.

[21] Appl. No.: 841,742

[22] Filed: Oct. 13, 1977

[51] Int. Cl.[2] ..... F01B 19/00

[52] U.S. Cl. ..... 93/93 C; 93/93 DP; 271/213

[58] Field of Search ..... 93/93 R, 93 C, 93 DP; 214/6 N; 271/207, 213

[56] References Cited

U.S. PATENT DOCUMENTS

| | | | |
|---|---|---|---|
| 427,849 | 5/1890 | Getten | 93/93 DP X |
| 2,855,150 | 10/1958 | Jasperson | 93/93 C |
| 3,772,972 | 11/1973 | Dutro et al. | 93/93 C |

OTHER PUBLICATIONS

IBM Technical Disclosure, vol. 17, No. 8, 1-1975, by Manning & Vetrone.

*Primary Examiner*—Leon Gilden
*Attorney, Agent, or Firm*—Shenier & O'Connor

[57] ABSTRACT

A copy set separating tray for use with a document copier operable to produce multiple collated sets of copies is mounted for manual movement between first and second positions transversely displaced relative to the copy delivery path of the copier to offset successive sets of copies to permit their ready separation. Movement of the tray in either direction between the first and second positions indexes a counter having a visual display to remind the operator how many copies or sets have been made.

14 Claims, 2 Drawing Figures

COPY SET SEPARATING TRAY FOR DOCUMENT COPIER

BACKGROUND OF THE INVENTION

There are a number of document copiers that are operable to produce collated sets of copies by making multiple passes of a single set of originals. During each pass the originals forming the set are fed in sequence, either fully automatically or semiautomatically, from a stack to an exposure station at which they are copied. By making only a single exposure of each original during each pass, it is possible to produce multiple sets of copies that are already collated without using sorting bins or the like. Suitable apparatus for feeding the originals semiautomatically or with each original being initially advanced manually is shown in U.S. Pat. No. 4,023,791, issued to Hori, et al., and in Hori, et al. application Ser. No. 755,181, filed Dec. 29, 1976.

It is desirable that the set of copies be not only collated, but also readily distinguishable or separable from one another. While it has been suggested that blank copy sheets be inserted after each pass to separate adjacent sets of copies, this expedient is wasteful, requires an extra control for the machine and after the copying operation is complete still requires the operator to examine the stack of copy sheets simply to find the separation points.

It is also desirable to provide a means for reminding the operator of how many copies have already been made. While there exist fully automatic feeders that advance each original to the exposure station a preselected number of times, thereby obviating the need to remind the operator, such feeders are generally more complicated and more expensive than the semiautomatic feeders referred to above.

SUMMARY OF THE INVENTION

One of the objects of our invention is to provide a copy set separating tray for a document copier which permits the operator producing collated sets of copies readily to separate the individual sets.

Another object of our invention is to provide a copy set separating tray for a document copier which informs the operator of a document copier producing collated sets of copies of the number of copies being made.

Still another object of our invention is to provide a copy set separating tray which is simple and inexpensive.

Other and further objects of our invention will be apparent from the following description.

In general, our invention contemplates, in a document copier operable to deliver successively along a delivery path a plurality of collated sets of copies of a single set of originals, apparatus comprising a receiving tray and means for mounting the tray for manually controlled movement between first and second shifted positions in the delivery path to offset successive sets of copies relative to one another to permit the ready separation thereof.

To remind the operator how many copies have been made, our invention further contemplates a counter having a visual display and means responsive to the movement of the receiving tray between the first and second shifted positions for indexing the counter. Our apparatus thus keeps track of the number of copies being made by a copier using semiautomatic feed without requiring any action by the operator other than shifting the receiving tray.

BRIEF DESCRIPTION OF THE DRAWINGS

In the accompanying drawings to which reference is made in the instant specification and in which like reference characters are used to indicate like parts in the various views.

DETAILED DESCRIPTION OF THE PREFERRED EMBODIMENT

Figure 2:
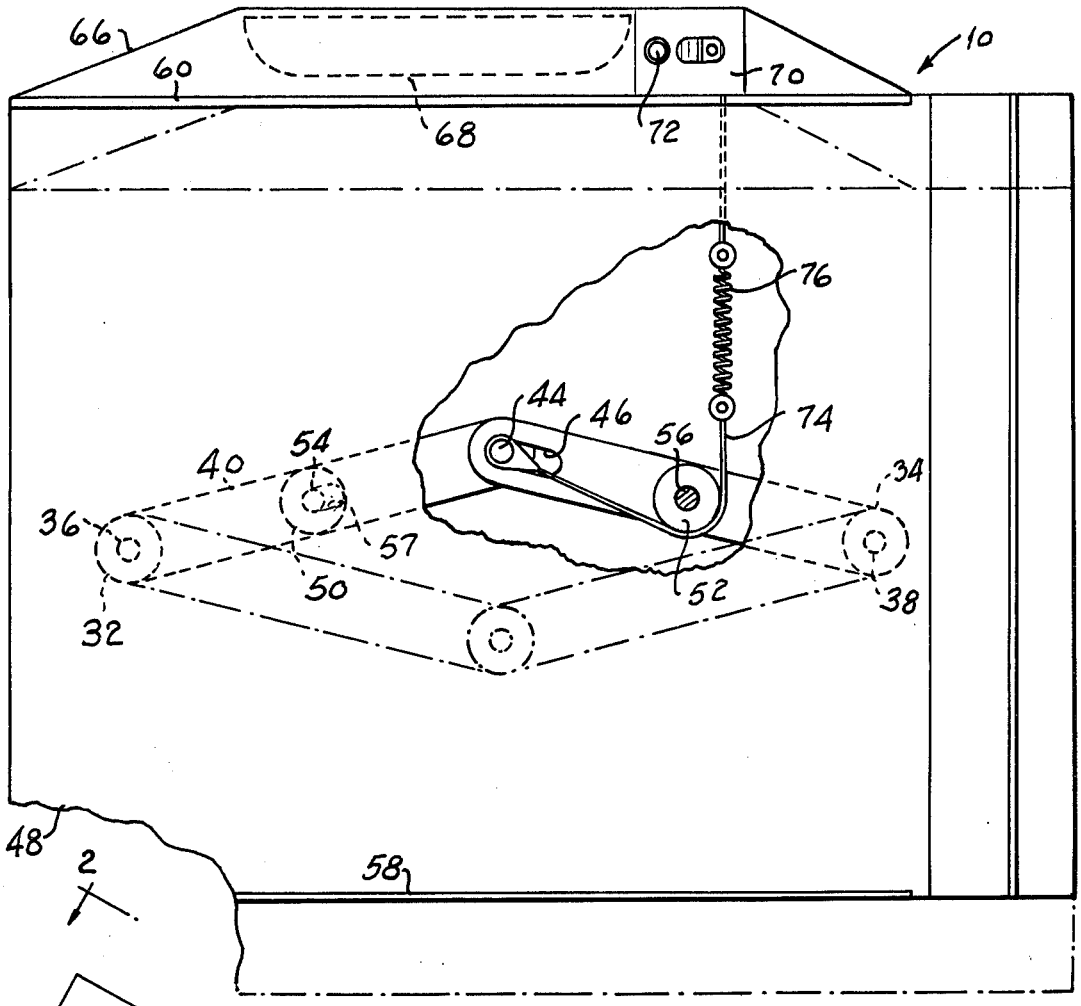
FIG. 2 is a fragmentary plan view of our copy tray taken along line 2—2 of FIG. 1.
Figure 1:
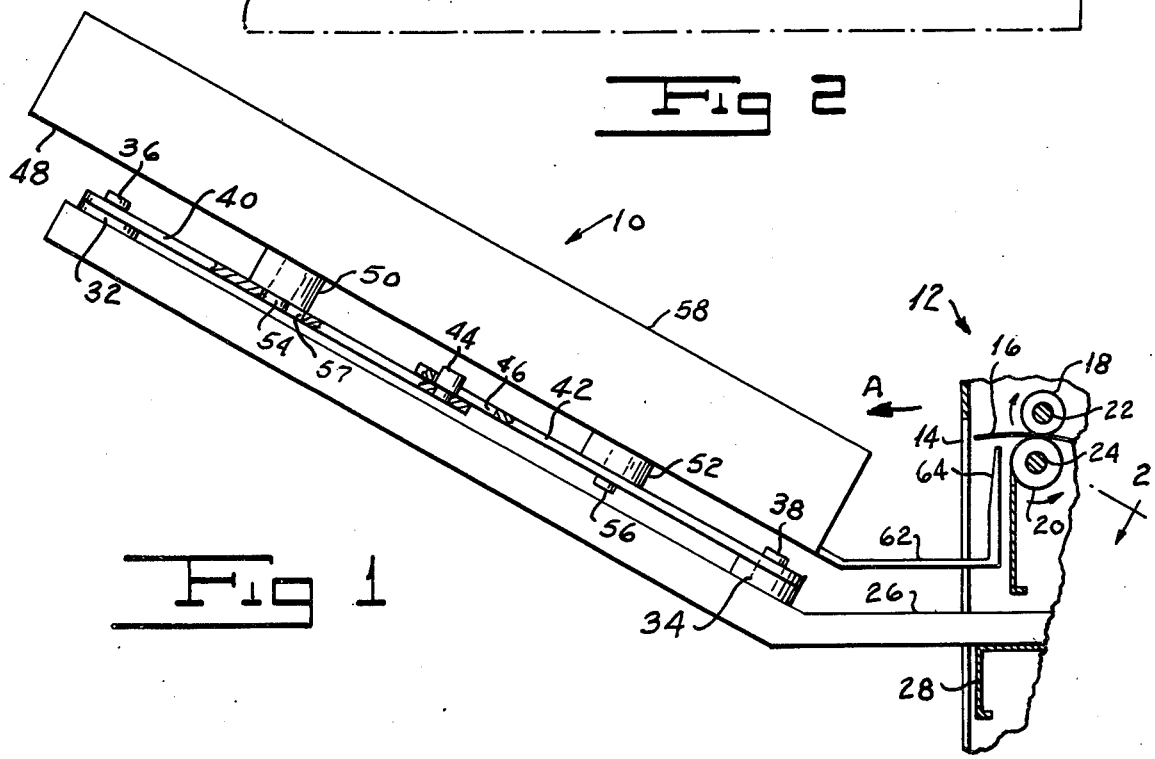
FIG. 1 is a fragmentary rear elevation of a copier to which one embodiment of our copy tray is attached with parts broken away and with other parts in section.

Referring now to FIGS. 1 and 2, our tray, indicated generally by the reference character 10, is designed to be used with a copier 12 that delivers a copy 16 through an opening in a sidewall 14. Copier 12 delivers the copy sheet 16 along a delivery path A by passing it between opposing feed rollers 18 and 20 supported by respective shafts 22 and 24.

The tray 10 comprises a base plate 26 which is rigidly attached to a frame portion 28 of the copier 12 by any suitable means known to the art and has an upwardly inclined portion 30 extending away from the sidewall 14. We pivotally secure the remote ends of a pair of toggle links 40 and 42 to the base plate 30, at points spaced longitudinally along the delivery path A, with respective pins 36 and 38. Respective cylindrical spacers 32 and 34 having relatively large bases space the links 40 and 42 slightly from the base plate 30. A longitudinal slot 46 formed near the adjacent end of link 42 receives a pin 44 carried by the adjacent end of link 40 to couple the links 40 and 42 for swinging movement between a first limit position shown in solid lines in FIG. 2 and a second limit position shown in dot-dash lines in the same view.

We attach a copy receiving tray 48 to intermediate portions of the links 40 and 42 by means of respective cylindrical spacers 50 and 52 and pins 54 and 56 received by the respective links 40 and 42. Link 42 receives pin 56 for pivotal movement only, while link 40 is formed with a longitudinal slot 57 to receive pin 54 for both pivotal and sliding movement to permit movement of the links 40 and 42 between their first and second limit positions. Links 40 and 42 thus support the tray 48 for movement transverse to the delivery path A between a first limit position shown in solid lines in FIG. 2 and a second limit position shown in dot-dash lines. Copies delivered from the copier 12 when the tray is in its first position are stacked along a first upstanding sidewall 58 while copies delivered when the tray is in its second position are stacked along a second sidewall 60. Preferably the attachment points between the tray 48 and the links 40 and 42 lie along the center line between sidewalls 58 and 60. No other support for the tray is required, owing to the relatively large bases of the spacers 32, 34, 50 and 52.

A level portion 62 on the tray 48 at its end nearest the copier 12 is formed with an upstanding end wall 64. The trailing edges of copies stacked along either sidewall 58 or 60 rest against the end wall 64. Preferably the tray 48 includes a handle 66 extending along one sidewall to facilitate manual movement between its limit positions. In the embodiment shown, the undersurface of the handle 66 is formed with an indentation 68 for receiving the fingers of the operator.

We mount a mechanical counter 70 having a reset button 72 on the sidewall of tray 48. Counter 70 is indexed by exerting sufficient tension on a line 74 wrapped around spacer 52 and coupled to the counter 70 through a spring 76. The other end of the line 74 carries an eyelet receiving the pin 44 coupling the links 40 and 42. Movement of the receiving tray 48 toward either limit position from an intermediate position increases the total path length from the pin 44 around spacer 52 to the counter 70 and thus produces sufficient tension in the line 74 to index the counter. The coupling between the links 40 and 42 and spacers 32, 34, 50 and 52 offers sufficient friction to resist the tendency of the spring to pull the tray 48 to an intermediate position. Alternatively, the tray 48 may include detents at its limit positions.

Before making copies, the operator first makes certain that the tray 48 is in one of its limit positions and pushes the reset button 72 to reset the counter 70 to one. He then individually supplies the originals from a stack to the copier 12 or semiautomatic feeder to make a first set of copies, the originals being supplied in such an order as to ensure that the copies are stacked in the tray 48 in proper sequence. After making a first set of copies, the operator moves the tray 48 to its other limit position, in the course of which operation the counter 70 indexes to two. The operator then supplies the originals to the copier 12 or feeder in the same manner as before to make a second set of copies which are stacked near the other sidewall 58 or 60 of the tray 48, offset from the first set. If additional sets of copies are required, he simply repeats the procedure as many times as necessary, shifting the tray 48 between limit positions before making each additional set. In this manner, the operator is able to offset successive sets of copies as they are made and, at the same time, keep track of the number of complete sets of copies. If the operator prefers that the count include the set currently being made, the operator may simply shift the tray 48 once after resetting the counter 70 initially to start the count at one.

It will be seen that we have accomplished the objects of our invention. Our tray permits the operator of a document copier producing collated sets of copies readily to separate the individual sets. Our tray informs the operator of the number of copies or sets being made. Finally, our tray is simple and inexpensive.

It will be understood that certain features and subcombinations are of utility and may be employed without reference to other features and subcombinations. This is contemplated by and is within the scope of our claims. It is further obvious that various changes mahy be made in details within the scope of our claims without departing from the spirit of our invention. It is, therefore, to be understood that our invention is not to be limited to the specific details shown and described.

We claim:

1. In a document copier operable to deliver successively along a delivery path a plurality of sets of copies of a single set of originals, each of said sets of copies being arranged in an order corresponding to that of the set of originals, apparatus comprising a receiving tray and means for mounting said receiving tray for manually controlled movement between first and second shifted positions in said delivery path to offset successive sets of copies relative to one another to permit the separation thereof, said mounting means mounting said receiving tray for movement between positions displaced transversely relative to said delivery path, said mounting means comprising a base member rigidly attached to said copier, a pair of links, means for pivotally coupling one end of one link to one end of the other link, means for pivotally coupling the other ends of said links to one of said receiving tray and said base member at points spaced longitudinally on said delivery path, and means for pivotally coupling said links at intermediate points to the other of said receiving tray and said base member at points spaced longitudinally on said delivery path, two of said coupling means also providing sliding coupling at one coupling point.

2. Apparatus as in claim 1 in which the other ends and intermediate points of said links are coupled respectively to said base member and said receiving tray.

3. Apparatus as in claim 2 in which said one link has a slot formed at said one end and said other link has a slot formed at said intermediate point, said first pivotal coupling means comprising a pin carried at said one end of said other link engaging said first slot for pivotal and sliding movement, said second pivotal coupling means allowing only pivotal movement of the other ends of said links relative to said base member, said third coupling means allowing only pivotal movement of said one link relative to said receiving tray and comprising a cylindrical spacer between said one link and said receiving tray, said apparatus further comprising a mechanical counter mounted on one side of said receiving tray and movable therewith and a line directed around said cylindrical spacer with one end of said line attached to said counter and the other end of said line being attached to said pin carried at said other end of said link, whereby movement of said receiving tray in either direction between said first position and second position increases the tension on said line at a certain point during said movement to actuate said counter.

4. Apparatus as in claim 1 in which said mounting means comprises spacers between said links and said receiving tray and base member at their coupling points.

5. Apparatus as in claim 4 in which said spacer members contact relatively large surface portions of said links and said receiving tray and base member.

6. Apparatus as in claim 4 in which said spacer members are cylindrical, said apparatus further comprising a mechanical counter and a line directed around one of said spacers, said line being attached at one said counter and attached at the other end to a portion of said mounting means whose distance from said spacer changes as said receiving tray is moved between said first and second positions.

7. Apparatus as in claim 6 in which said distance increases over one portion and decreases over another portion of the movement of said receiving tray between said first and second portions.

8. Apparatus as in claim 1 in which at least one of said two coupling means also providing sliding coupling allows sliding movement only over a limited range to limit the movement of said receiving tray at said first and second positions.

9. In a document copier operable to deliver successively along a delivery path a plurality of sets of copies of a single set of originals, each of said sets of copies being arranged in an order corresponding to that of the set of originals, apparatus comprising a receiving tray, means for mounting said receiving tray for manually controlled movement between first and second shifted positions in said delivery path to offset successive sets of copies relative to one another to permit the separation thereof, a counter having a visual display, and means responsive to the movement of the receiving tray between said first and second positions for indexing said counter.

10. Apparatus as in claim 9 in which said receiving tray is movable manually between said first and second positions.

11. Apparatus as in claim 9 in which said receiving tray is formed with a handle.

12. Apparatus as in claim 9 in which said handle is on a side of said receiving tray.

13. Apparatus as in claim 9 in which said receiving tray extends upwardly in the direction of delivery of said copy sheet and has an upwardly extending retainer at the leading end thereof relative to said delivery path.

14. Apparatus as in claim 9 in which said receiving tray has upstanding sidewalls parallel to said delivery path and so spaced from each other that copies are delivered along one sidewall when the tray is in said first position and are delivered along the other sidewall when the tray is in said second position.

* * * * *